US006374564B1

(12) United States Patent
Fletterick et al.

(10) Patent No.: US 6,374,564 B1
(45) Date of Patent: Apr. 23, 2002

(54) SUSPENDED CURVED CEILING SYSTEM

(75) Inventors: James A. Fletterick, Olmsted Falls; Martin E. Likozar, Richmond Hts, both of OH (US)

(73) Assignee: USG Interiors, Inc., Chicago, IL (US)

( * ) Notice: Subject to any disclaimer, the term of this patent is extended or adjusted under 35 U.S.C. 154(b) by 0 days.

(21) Appl. No.: 09/584,336

(22) Filed: May 31, 2000

(51) Int. Cl.[7] ..... E04B 2/00
(52) U.S. Cl. ..... 52/506.07
(58) Field of Search ..... 52/506.07, 506.06, 52/311.2, 798.1

(56) References Cited

U.S. PATENT DOCUMENTS

| | | | | | |
|---|---|---|---|---|---|
| 426,558 | A | | 4/1890 | Dithridge | |
| 1,360,720 | A | | 11/1920 | Brown et al. | |
| 1,407,242 | A | | 2/1922 | Wylie | |
| 3,159,251 | A | * | 12/1964 | Becker | 52/506.07 |
| 4,048,777 | A | | 9/1977 | Carroll | 52/309.12 |
| 4,297,825 | A | | 11/1981 | Harper, Jr. | 52/729 |
| 4,434,599 | A | | 3/1984 | McCall | 52/729 |
| 4,505,083 | A | | 3/1985 | Mieyal | 52/476 |
| 4,542,615 | A | | 9/1985 | McCall | 52/729 |
| 4,677,802 | A | | 7/1987 | Vukmanic | 52/488 |
| 4,679,375 | A | | 7/1987 | Shirey | 52/777 |
| 4,932,170 | A | * | 6/1990 | Spear | 52/28 |
| 5,088,261 | A | * | 2/1992 | Mieyal et al. | 52/729 |
| 5,154,031 | A | | 10/1992 | Wall | 52/484 |
| 5,201,787 | A | * | 4/1993 | LaLonde et al. | 52/484 |
| 5,325,647 | A | | 7/1994 | Forry et al. | 52/309.15 |
| 5,347,783 | A | * | 9/1994 | Frecska et al. | 52/506.07 |
| 5,413,300 | A | * | 5/1995 | Hosteing | 52/506.06 X |
| 5,611,185 | A | | 3/1997 | Wilz | 52/506.07 |
| 5,930,966 | A | | 8/1999 | Wood et al. | 52/364 |
| 6,047,512 | A | * | 4/2000 | Wendt et al. | 52/506.07 |

FOREIGN PATENT DOCUMENTS

| | | |
|---|---|---|
| GB | 14278 | of 1852 |

* cited by examiner

*Primary Examiner*—David M. Purol
(74) *Attorney, Agent, or Firm*—Pearne & Gordon LLP

(57) ABSTRACT

A suspended three-dimensional ceiling system of improved appearance and performance that includes closely dimensioned main tees and lay-in panels. The main tees have opposed vertical surfaces adapted to abut the edges of the panels to avoid any noticeable non-parallelism between the main tees and/or panels. The vertical surfaces are provided by a protrusion at the juncture between a panel supporting flange and a vertical stem of the main tee. The protrusion allows the panels to be dimensioned to avoid undue interference with a stiffening bulb on the upper part of the stem and provides an attractive reveal on the visible face of the flange.

10 Claims, 3 Drawing Sheets

FIG. 2
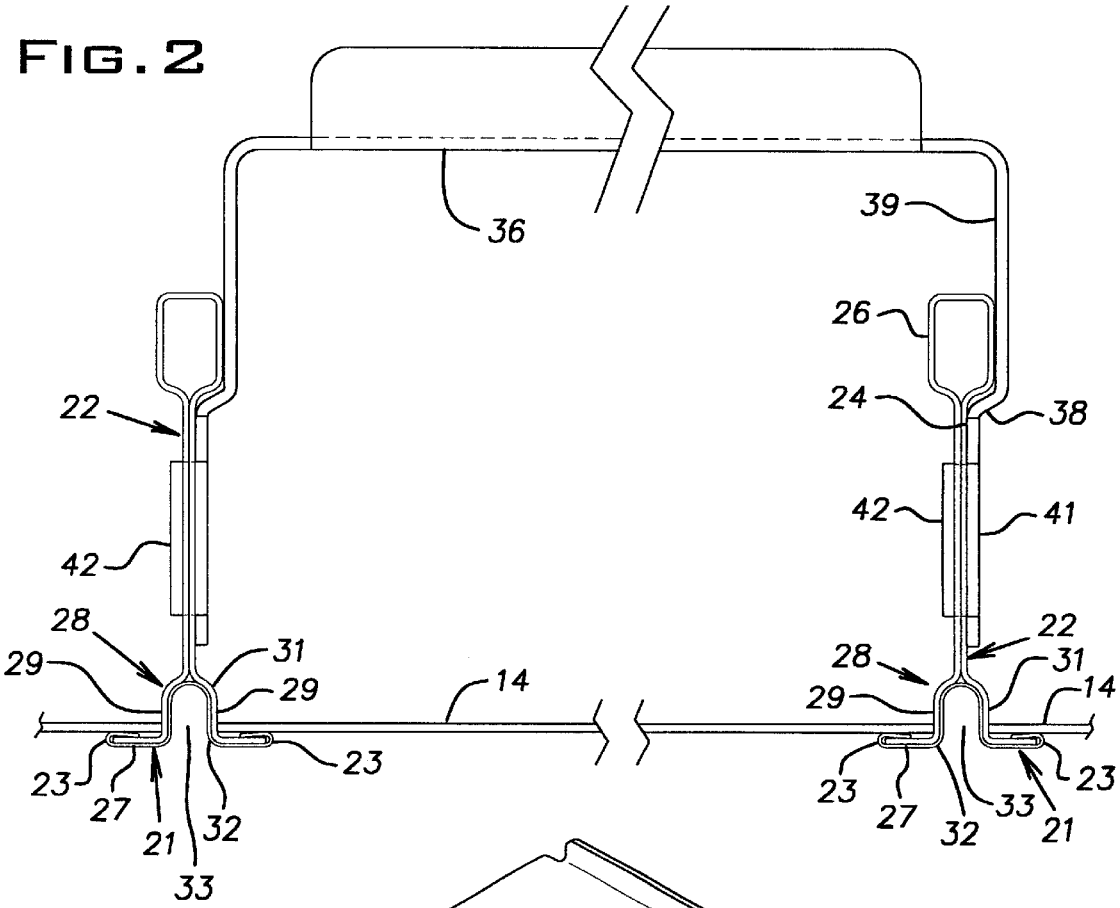
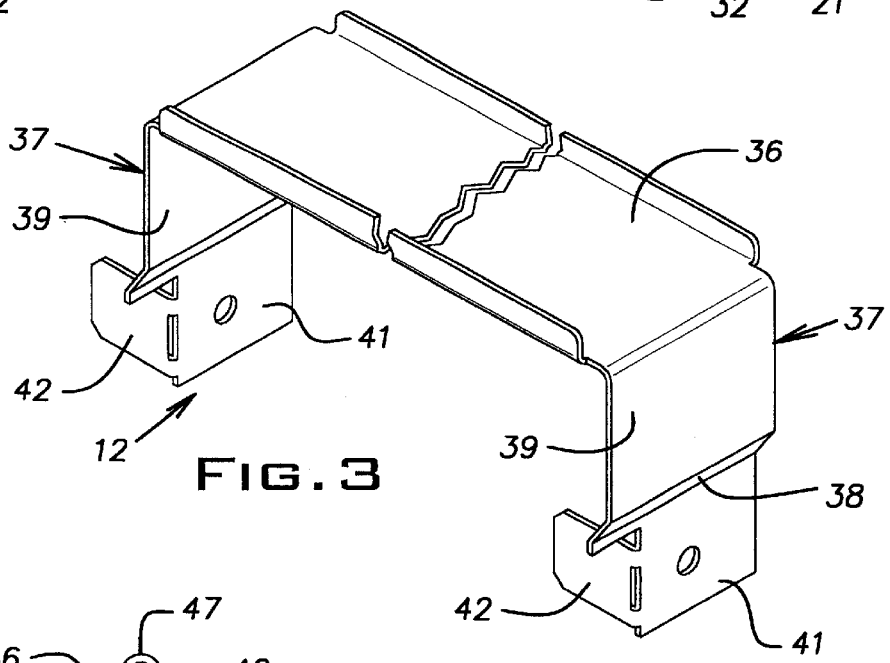
FIG. 3
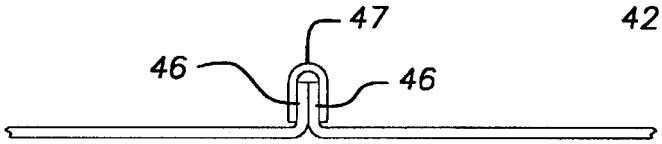
FIG. 4

FIG. 5
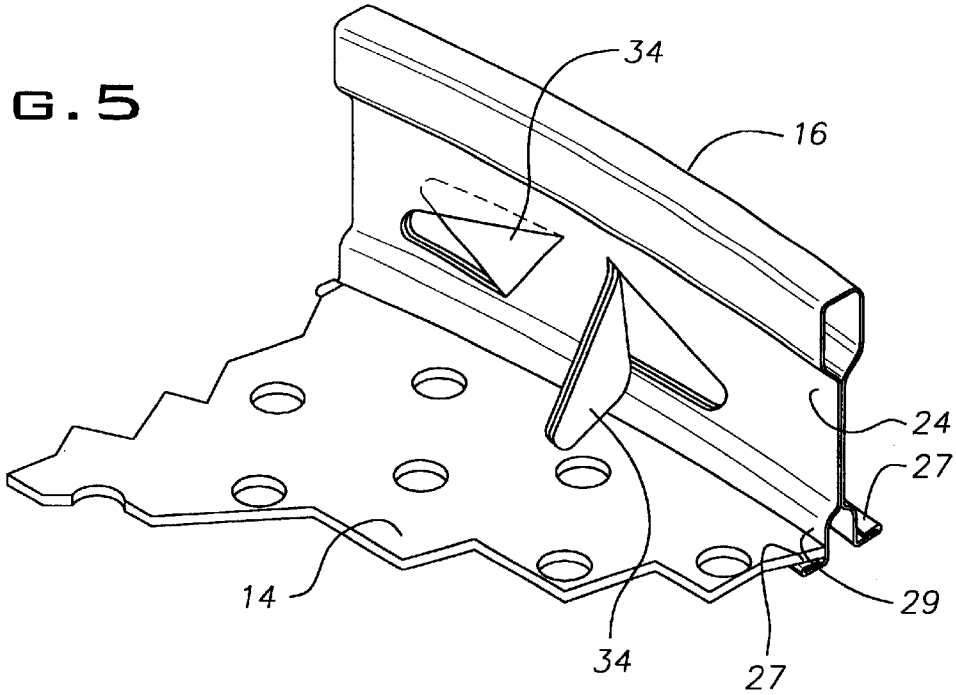
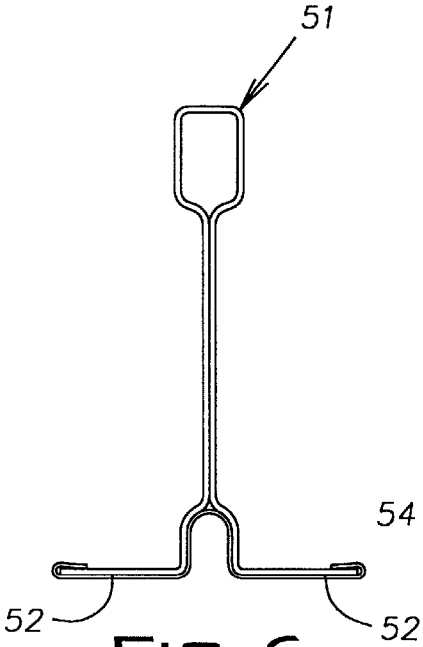
FIG. 6
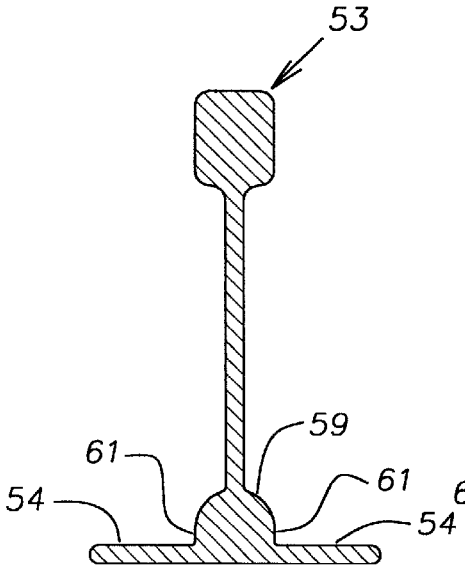
FIG. 7
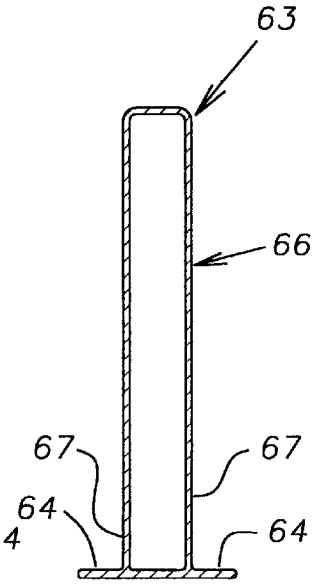
FIG. 8

SUSPENDED CURVED CEILING SYSTEM

BACKGROUND OF THE INVENTION

The invention relates to suspended ceiling construction and, in particular, to improvements in so-called three-dimensional ceilings.

PRIOR ART

Suspended three-dimensional ceilings with gentle wave-like configurations have been available for specialty applications where a dramatic or custom look is desired. Such ceilings find application in contemporary office environments, entertainment and gaming complexes, high-bay areas and retail space, for example.

The subject ceiling structures include convex (vault) and concave (valley) main grid runners or tees assembled with grid cross members in the form of cross tees or stabilizer bars. Typically, the primary purpose of three-dimensional ceilings is to provide a highly visible decorative structure. Consequently, a precision assembly is especially important so that visually distracting misalignments are avoided. A popular form of three-dimensional ceiling is a one-directional type where the lay-in panels are relatively long and where the joints between panels are not masked by visible cross ties. These one-directional systems are particularly prone to show misalignments of the grid structure and lay-in panels especially where the lay-in panels have a geometric pattern. In prior art constructions, the lay-in panels can take a skewed position on the supporting grid tee flanges. This misalignment is very visible and in severe conditions can even result in a panel falling off of a tee flange.

Installation of the main runners of a three-dimensional ceiling is more complex and requires more care than normally expended for conventional planar suspended grid ceilings. For example, considerable care is necessary in placement of suspension hanger wires so that when completed they hang relatively plumb in both directions of the grid. Achieving this condition is made difficult because the spacing between wires is variable depending on the inclination of the area of the grid being suspended. The extra time and effort involved in laying out and achieving a proper spacing for hanger wires longitudinally along the runners can detract from the time and effort spent in properly locating the lateral positions of the wires. These factors are in addition to the physical obstacles or conditions that can exist in the ceiling space which interfere with the proper spacing of the hanger wires. These problems have given rise to the need for a three-dimensional grid system that is more tolerant of imperfect suspension conditions and contributes to efforts at precisely positioning the grid ceiling structure.

SUMMARY OF THE INVENTION

The invention provides an improved three-dimensional ceiling that has self-aligning features which contribute to increased positional accuracy of both the grid and the panel members. More specifically, the ceiling system has main tees with a cross-sectional configuration that cooperates with specially proportioned lay-in panels to improve the parallelism of the grid tees as well as the parallelism of the panels to the grid tees. In one disclosed system, the main tees have a stem configured with an increased thickness at its lower edge where it joins the panel supporting flanges. Preferably, the thickness of the stem at its lower edge is at least about as large as its thickness adjacent its upper edge where it has a typically enlarged cross-sectional area or bulb for stiffening. This thickened stem geometry allows the components to be dimensioned so as to eliminate excessive lateral clearance between the tees and lay-in panels. The disclosed geometry still allows the panels to be assembled on the tees from a point above the grid without interference with the upper regions of the main tees.

The wide stem geometry of the main tees of the invention and correlated width of the lay-in panels is particularly important with one directional three-dimensional style ceilings. This style has no cross-tees at the visible lower face of the grid and, therefore, cannot rely on such structures to gauge and control the spacing between main runners at this face.

Stabilizer bars conventionally used to connect adjacent main tees together have a stepped or bridge-like construction to provide clearance for the installation of the lay-in panels. Typically, one-directional panels have their ends bent upwardly to form a flange that is used to couple with a mating end of another panel. The configuration of the stabilizer bars allows end-wise motion of the lay-in panels during installation and must be high enough above the supporting main tee flanges to allow the upwardly extending panel flanges to pass under the stabilizer bars. The somewhat complex geometric stabilizer bar configuration does not lend itself to precise control of the spacing of the lower visible faces of the main tees.

Many of the lay-in panel materials are relatively shear because of their translucence and/or perforated design. It is a practice to stagger the locations of the stabilizer bars between successive rows of main tees so that any shadow of a stabilizer bar visible through a lay-in panel is discontinuous and, therefore, less conspicuous. This practice exacerbates the difficulties in precisely positioning the main tees with the stabilizer bars since they do not stack up in a direct line.

BRIEF DESCRIPTION OF THE DRAWINGS

FIG. 2 is an enlarged cross-sectional view of the ceiling system taken in the plane 2—2 indicated in FIG. 1;

FIG. 3 is a fragmentary perspective view of a stabilizer bar of the illustrated ceiling system;

FIG. 4 is an enlarged fragmentary cross-sectional view of the end joint of a pair of abutting lay-in panels and an associated panel splice, taken in the plane 4—4 indicated in FIG. 1;

FIG. 5 is an enlarged fragmentary perspective view of the ceiling showing an integral hold down tab restraining a lay-in panel against the flange of a supporting tee;

FIG. 6 is a cross-sectional view of a modification of a main tee of the invention;

FIG. 7 is a cross-sectional view of another modification of a main tee of the invention; and FIG. 8 is a cross-sectional view of still another modification of a main tee of the invention.

DESCRIPTION OF THE PREFERRED EMBODIMENT

Figure 1:
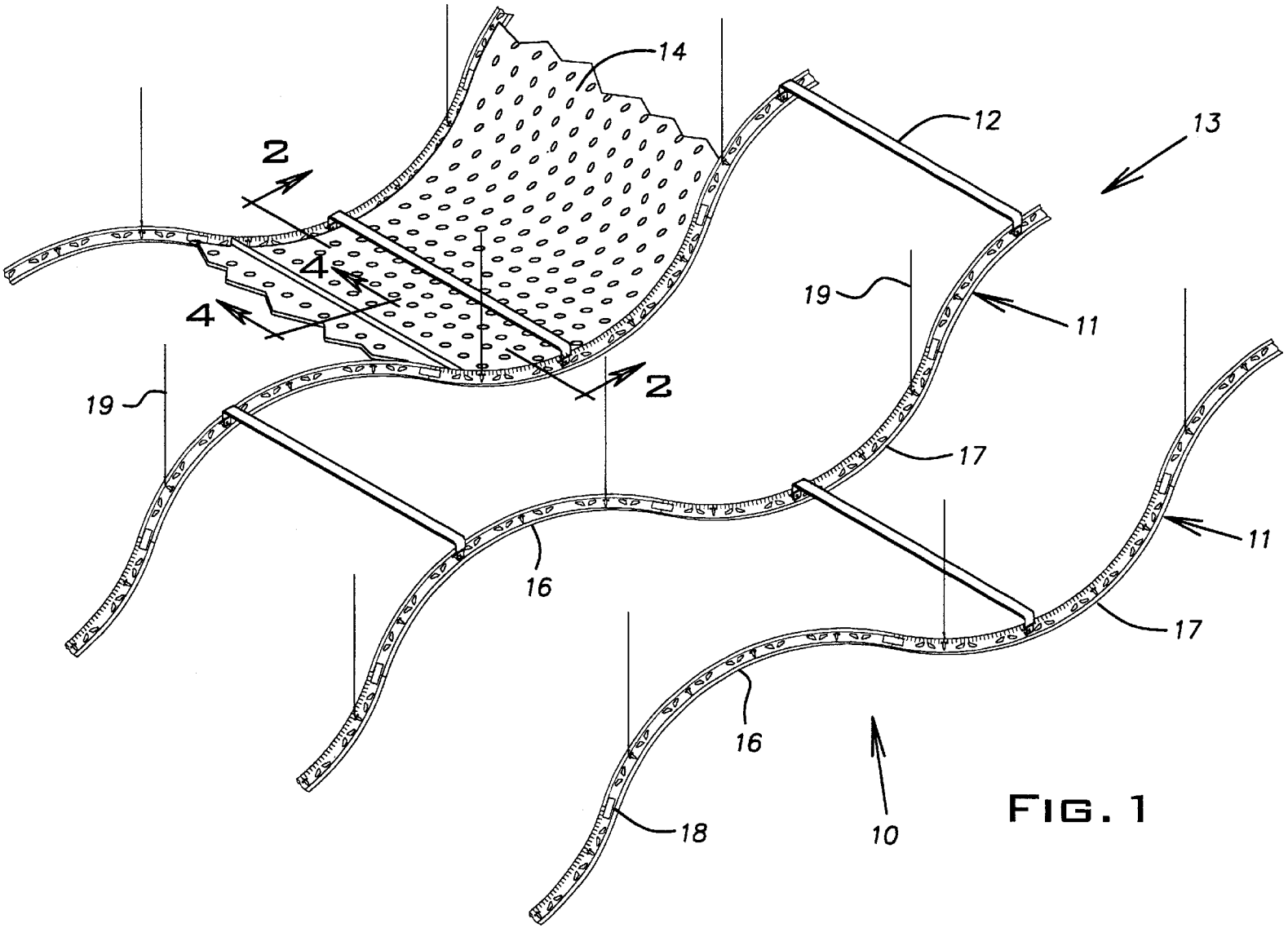
FIG. 1 is a perspective view, from above, of portions of a three-dimensional ceiling system embodying the invention, with the majority of the lay-in panels not shown for purposes of clarity.

FIG. 1 illustrates a specialty three-dimensional suspended ceiling system 10 constructed in accordance with the invention. The system 10 includes parallel rows of main runners or tees 11 interconnected with cross runners 12 to form a grid 13. Supported on the main runners 11 are decorative lay-in panels 14. Segments 16, 17 of the main runners 11 are curved in vertical planes so as to form vaults 16 or valleys 17. Typically, an architect or designer can select combinations and patterns of these vaults 16 and valleys 17 or simply all vaults or all valleys as he or she chooses to construct the desired look. The adjacent ends of the segments 16, 17 of the main runners 11 are joined together by suitable clips 18 having bendable tabs inserted into appropriate slots provided in the segments adjacent their ends. The main runners 11 are suspended from overhead structure by wires 19 in a generally conventional manner except that the horizontal spacing between wires along a given main runner varies in relation to the inclination of the local part of a runner since the holes for receiving the suspension wires are uniformly spaced along the arcuate length of the runner. This irregular spacing requires extra attention by the installer and can present situations where accurate placement of the suspension points for the wires in both the longitudinal direction of the main runners 11 and in the lateral direction of the cross runners 12 suffers. Inaccurate location of the suspension points causes the wires to be out of plumb and makes it difficult to locate and construct a grid that is "square" so that the cross-runners and joints between panels are perpendicular to the main runners and also makes it difficult to hold the main runners in a straight line lying in an imaginary flat vertical plane. When properly installed, the main tees 11 lie in vertical planes and, from row to row, are in phase with one another so that the local elevation of one main tee is the same as the other tees along a horizontal line perpendicular to all of the tees. A main tee can be manufactured with a radius of curvature, measured at the visible face of its flange 21, of between 30.5 in. (77.5 cm) to about 229 in. (582 cm) or larger, for example.

FIG. 2 illustrates the cross section of a main tee vault segment 16. The cross section, which is symmetrical about an imaginary vertical central plane has a lower, generally horizontal flange 21 and a generally vertical stem 22. With reference to FIG. 2, the main tees 11 are of a "narrow face" design such that the flange is relatively narrow, e.g. about 9/16 in. (1.43 cm) measured across its edges 23. The stem 22 includes a narrow, vertical web 24 and an enlarged hollow stiffening bulb 26 adjacent the upper edge of the web 24. Integrally formed on the stem 22 between opposed portions 27 of the flange 21 adjacent a lower edge of the web 24 is a protrusion or spacer 28 that is preferably continuous with the length of the segment 16, and is symmetrically disposed about the central imaginary plane of the cross-section.

The spacer 28 has generally vertical surfaces 29 that extend above the flange portions 27 a distance that is large in comparison, for example, to the wall thickness of either the flange 21 or web 24, for example.

In the construction illustrated in FIG. 2, the main tee segments 16, 17 are made of roll-formed sheet metal such as steel painted or otherwise provided with a protective coating. More specifically, the main tee segments 16, 17 are formed of two metal strips, a first strip 31 forming essentially the outline of the tee section and a second strip 32 being a cap that locks the first strip 31 in its rolled configuration when it is rolled over the flange areas of the first strip. The lower or visible face of a tee 16, 17 has a hollow, central groove, which is the interior of the protrusion 28, that is aesthetically desirable for its "reveal" character. Integral "hold-down" tabs 34 are stamped from the web 24 at regularly spaced locations along the segments 16, 17. The valley segments 17 have a cross-section configuration like that of the vault segments except that the area of the bulb 26 is crimped to facilitate forming them into their convex or valley-shape.

FIGS. 2 and 3 illustrate details of a typical cross-tie or stabilizer bar 12 that extends between and interconnects with adjacent main runners 11. The stabilizer bar 12 is preferably formed as a unitary sheet-metal stamping having a main channel body 36. Each end of the body 36 has a depending leg 37. The legs 37 are formed with a web mid-section 38 so that the plane of an upper portion 39 of the leg 37 is off-set from the plane of a lower portion 41 of the leg. The offset leg configuration enables the lower portions 41 to abut the web 24 of a main tee segment 16, 17 while the upper part 39 extends past the bulb 26 of the main tee segment.

The stabilizer bars 12 are assembled on the main tees 11 so that upon completion of the ceiling they are above the planes occupied by the lay-in panels 14. The stabilizer bars 12 are assembled by positioning integral tabs 42 in slots stamped through the webs 24 of the main tees at regularly spaced locations. Once fully received in the slots, the tabs 42 are bent over against the webs 24 to lock the bars 12 in position. The depending legs 37 of the stabilizer bars 12 hold the channel section 36 well above the main tee flanges 21.

The three-dimensional ceiling system illustrated in FIG. 1 is sometimes referred to in the industry as a "one-directional" style. This style is typically characterized by the absence of visible cross tees and inconspicuous joints between lay-in panels. The lay-in panels 14 are relatively long in comparison to their width being a nominal six feet (1.83 meters) long and a nominal two feet (0.61 meters) wide. The illustrated panels 14 have their ends turned up into flanges 46. Abutting flanges 46 of adjacent panel ends can be held together with an inverted U-shaped joint splice 47. The joint splice 47 is advantageously formed of a soft metal capable of being squeezed with pliers or like tools to tighten the abutting flanges 46 together. The lay-in panels 14 are assembled on the grid 13 by sliding them under the stabilizer bars 12. The vertical height of the main channel body 36 of the bars 12 above the main tee flanges 21 provides ample clearance for the end flanges 46 of the panels 14. The lay-in panels 14 are typically offered in a variety of materials of different opacity, translucency and/or perforation patterns. Typical lay-in panel materials include smooth or perforated painted aluminum, brass or stainless steel woven mesh, anodized aluminum and translucent fiber-reinforced plastic panels. The thickness of these panels can range from 0.020 in. (0.051 cm) to 0.080 in. (0.203 cm) so that they are relatively flexible.

The hold down tabs 42 are bent out of the plane of the web 24 and down against the panels 14 at appropriate locations to make the panels conform to the curvature of the main tees 11. Typically, the material of the panels 14 is somewhat resilient and tends to maintain a planar configuration when not constrained by the tabs 43. The lay-in panels 14 have increased lateral stiffness, i.e. compression, between main tees 11 when they assume the curved configuration of the main tees.

In accordance with the invention, the main tees 11 and lay-in panels 14 are configured to inter-engage in such a manner that they contribute to their mutual alignment so that the main tees and the panels are urged into precise parallel alignment. By way of example, but not limitation, a panel 14 can be sized with a nominal width of 23.75 in. (60.3 cm) and the stem spacer 28 can have a nominal horizontal thickness of 0.220 in. (0.559 cm). These proportions leave a relatively small nominal clearance of 0.030 in. (0.076 cm) between a panel and the adjacent main runners 11. This clearance, theoretically, would require adjacent main tees 11 to be parallel to one another and to a panel at the plane of the flange 21 within 0.030 in. (0.076 cm) in six feet. While a nominal clearance of about 0.030 in. (0.076 cm) is most preferred for some applications such as illustrated in FIG. 1, the invention can be practiced by using other clearance dimensions with decreasing precision of positioning. For example, clearances ranging from a nominal clearance dimension of 0.060 in. (0.152 cm) up to as much as about 0.090 in. (0.229 cm), if desired or necessary can be used.

It will be appreciated from an understanding of the geometry of the stabilizer bars 12 and their locations remote from the plane of the flanges 21 and their manner of field installation that it is difficult to maintain precise parallel positioning of the main tees 11 at the plane of the flanges 21 simply with the stabilizer bars. The positional accuracy of the flanges 21, of course, is important because it is these elements that are visible from the space below the ceiling system 10. Precise control of the position of the main tees 11 with the stabilizer bars 12 is made more difficult by the practice of staggering these stabilizer bars in patterns like that shown in FIG. 1. The close parallel registration that can be maintained between the tees 11 and panels 14 with the invention results in a high quality finished appearance of the ceiling system 10. This is especially important with the general type of disclosed three dimensional ceiling since it is under increased visibility by virtue of being a specialty item intended to draw visual attention. Often, the lay-in panels 14 have a regular geometric pattern that accentuates any misalignment between them and the main tees 11.

It is important that the width of the stem of the spacer is at least approximately as large as the maximum width of other portions of the stem—specifically the stiffening bulb 26—so that the panels 14 can be laid in the grid 13 without undue interference. FIGS. 6–8 illustrate other examples of main tee cross-sectional shapes that can be used in practicing the invention. Typically, the cross-sections are symmetrical about an imaginary vertical central plane. In FIG. 6, a main tee 51 has a cross-section like that of the main tee 11 of FIG. 2 except that the flange portions 52 are proportionately wider. A main tee 53 of FIG. 7 is an extrusion of thermoplastic or thermosetting resin or of aluminum. The tee 53 includes panel supporting flange portions 54, a stem 56 comprising a web 57, a solid stiffening bulb 58 and a solid spacer 59. The spacer 59 includes vertical surfaces 61 for cooperation with the edges of a lay-in panel sized to minimize horizontal clearance between the panels and the main tees 53 as disclosed hereinabove. FIG. 8 shows the cross-section of an extruded main tee 63 formed of suitable plastic or aluminum or other suitable rigid material. The tee 63 includes panel supporting flange portions 64 and a hollow stem 66. The stem 66 includes vertical spacer surfaces 67 adapted to cooperate with a lay-in panel sized in the manner described above to improve positional accuracy of the grid and panel.

It will be understood from the foregoing disclosure that the invention can be employed in various other types of three-dimensional ceiling styles such as those in which the panels are shorter rectangles of nominally 2 ft.×4 ft. (0.610 meters×1.22 meters) or are square, nominally 2 ft.×2 ft. (0.610 meters×0.610 meters). Still further, variants of the invention can utilize conventional cross tees, known in the art, visible from below the panels at selected centers.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A main tee for a three-dimensional ceiling, the tee being symmetrical about an imaginary central plane that is vertical in an installed condition and having with reference to the installed condition of the tee, a generally vertical stem with opposite faces and flange portions extending generally perpendicularly from the stem at each face of the stem, the tee having a radius of curvature in a vertical plane, a stiffening bulb at an upper edge of the stem and being wider than a mid-area of the stem below the bulb, the stem having an increased thickness, below said mid-area, measured horizontally for a limited distance above the flange, the increased thickness of the stem above the flange being about equal to the thickness of the bulb.

2. A main tee as set forth in claim 1, wherein said stem is cut to provide integral hold down tabs that are adapted to be bent downwardly to retain a panel on the flanges.

3. A three-dimensional ceiling system comprising a plurality of main tees spaced from one another in imaginary parallel vertical planes, the main tees being curved in their respective vertical planes and being in phase with each other so that the local elevation of one tee is the same as the other tees along a horizontal line perpendicular to all of the tees, each of the main tees having a lower area with a panel supporting flange and an upper area including a stem extending in a generally vertical plane, the stem having opposed vertical surfaces, the flange having portions extending in opposite directions away from the vertical plane of the stem, cross ties inter-connecting the main tees in the manner of a grid, flexible lay-in panels supported on the flange portions of the main tees in an arcuate plane determined by the radius of curvature of the main tees in their vertical planes, the lay-in panels being proportioned in their width to closely fit with opposed vertical surfaces of the stems of adjacent main tees such that the panels are closely aligned in parallelism with the main tees and the panels are capable of confining the main tees into close parallel alignment to one another, the nominal clearance between the panels and the stems of the main tees being a small fraction of the width of the panel supporting areas of the flanges.

4. A ceiling system as set forth in claim 3, wherein said lay-in panels have a lengthwise dimension that is a multiple of their lateral dimension.

5. A ceiling system as set forth in claim 3, wherein said cross ties are disposed above the lay in panels.

6. A ceiling system as set forth in claim 3, wherein said panels have upturned flanges at their ends.

7. A ceiling system as set forth in claim 6, wherein said cross ties are sufficiently elevated above the main tees to enable the upturned flanges of the panel ends to pass thereunder.

8. A ceiling system as set forth in claim 5, wherein said cross ties between a pair of adjacent main tees are staggered from cross ties between one of said adjacent main tees and a third main tee.

9. A ceiling system as set forth in claim 3, wherein said stem including a stiffening bulb at its upper part and a protrusion at its lower part and a relatively narrow web between said bulb and protrusion, said protrusion being substantially continuous along the length of the main tee.

10. A ceiling system as set forth in claim 3, wherein said main tees have integral hold down tabs displaceable to retain the panels to conform to the curvature of the main tees.

* * * * *